US009975723B2

(12) United States Patent
Satsukawa

(10) Patent No.: US 9,975,723 B2
(45) Date of Patent: May 22, 2018

(54) IMAGE FORMING APPARATUS AND SHEET CONVEYANCE METHOD

(71) Applicant: KONICA MINOLTA, INC., Chiyoda-ku, Tokyo (JP)

(72) Inventor: Takamitsu Satsukawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 1 day.

(21) Appl. No.: 15/176,688

(22) Filed: Jun. 8, 2016

(65) Prior Publication Data

US 2017/0008724 A1 Jan. 12, 2017

(30) Foreign Application Priority Data

Jul. 10, 2015 (JP) ..... 2015-138228

(51) Int. Cl.

*B65H 39/10* (2006.01)
*B65H 31/24* (2006.01)
*B65H 7/06* (2006.01)
*G03G 15/00* (2006.01)

(52) U.S. Cl.

CPC ..... *B65H 31/24* (2013.01); *B65H 7/06* (2013.01); *G03G 15/5016* (2013.01); *G03G 15/70* (2013.01); *B65H 2511/528* (2013.01); *B65H 2513/42* (2013.01); *B65H 2601/11* (2013.01);

(Continued)

(58) Field of Classification Search

CPC ... B65H 5/26; B65H 7/02; B65H 7/06; B65H 7/20; B65H 31/24; B65H 2511/528; B65H 2601/11; B65H 2601/255; B65H 2513/42; G03G 15/70; G03G 2215/00552

See application file for complete search history.

(56) References Cited

U.S. PATENT DOCUMENTS 5,489,968 A * 2/1996 Rossbach ..... G03G 15/5012 399/20
7,469,896 B2 * 12/2008 Sato ..... B65H 31/24 271/287
9,141,067 B2 9/2015 Serizawa (Continued)

FOREIGN PATENT DOCUMENTS

JP 2008052125 A 3/2008
JP 2013235137 A 11/2013

(Continued)

*Primary Examiner* — Prasad V Gokhale
(74) *Attorney, Agent, or Firm* — Holtz, Holtz & Volek PC

(57) ABSTRACT

An image forming apparatus includes: an operating unit configured to display an operation screen, and accept a user operation; a conveying unit configured to convey a sheet along a path to one of a plurality of discharge destinations; an image forming unit configured to form an image on the sheet moving in the path; and a control unit configured to identify a conveyance destination, and cause the conveying unit to convey the sheet to the conveyance destination, wherein, when a jam in the path is detected, the control unit causes the conveying unit to suspend sheet conveyance, and causes the operating unit to display a select screen for selecting a purge destination and accept a purge destination selected by a user, and the control unit identifies a sheet to be moved to the purge destination, and causes the conveying unit to convey the sheet to the purge destination.

10 Claims, 9 Drawing Sheets

(52) U.S. Cl.
CPC ..... *B65H 2801/06* (2013.01); *G03G 2215/00552* (2013.01)

(56) References Cited

U.S. PATENT DOCUMENTS

| | | | | |
|---|---|---|---|---|
| 9,229,413 | B2 | 1/2016 | Saitsu | |
| 2009/0110411 | A1* | 4/2009 | Gungor | G03G 15/55 399/20 |
| 2013/0256988 | A1* | 10/2013 | Takahashi | B41J 13/00 271/270 |
| 2014/0241737 | A1* | 8/2014 | Shirasaka | G03G 15/6552 399/20 |
| 2015/0168907 | A1* | 6/2015 | Nishi | B65H 43/00 399/21 |

FOREIGN PATENT DOCUMENTS

| | | | |
|---|---|---|---|
| JP | 2014164011 | A | 9/2014 |
| JP | 2015036741 | A | 2/2015 |

* cited by examiner

700

IMAGE FORMING APPARATUS AND SHEET CONVEYANCE METHOD

The entire disclosure of Japanese Patent Application No. 2015-138228 filed on Jul. 10, 2015 including description, claims, drawings, and abstract are incorporated herein by reference in its entirety.

BACKGROUND OF THE INVENTION

Field of the Invention

The present invention relates to a sheet conveyance technique, and more particularly, to a purge technique.

Description of the Related Art

An image forming apparatus such as a printer or a copying machine normally forms an image on each sheet while successively conveying sheets along one path. In a case where a defect such as a paper jam (a jam) or image quality degradation happens to a sheet moving in the path, the image forming apparatus normally suspends processing, and forcibly keeps the other moving sheets at appropriate locations in the path. To cause the image forming apparatus to resume the processing, all the sheets on which any processing can no longer be performed among the suspended sheets need to be removed from the path. However, leaving this removal operation to a user imposes a heavy burden on the user.

There is a type of conventional image forming apparatus that automatically removes sheets staying in the path when processing is suspended to free the user from the burden (see JP 2015-036741 A, JP 2014-164011 A, JP 2013-235137 A, and JP 2008-052125 A, for example). This removal operation is called "purge". Sheets as purge targets are purged and moved to a different discharge destination from the original discharge destination. The different discharge destination, or a purge destination, is normally a tray or a cassette or the like provided for purges. Furthermore, in a large-sized apparatus such as a projection printer (PP) or larger, two or more discharge destinations are already provided at appropriate locations in the path. One discharge destination selected beforehand from among the discharge destinations by a user, or the discharge destination that is located on the upstream side of the site of occurrence of a jam and is the closest to the site of occurrence of the jam among the discharge destinations is used as the purge destination (see JP 2014-164011 A, for example).

Normally, a conventional image forming apparatus automatically performs a purge every time a defect occurs in sheet conveyance. However, when such an apparatus is made to print a confidential document, such a purge is accompanied by a risk of information leakage. In reality, a user sometimes fails to remove the purged sheets, since the purge destination differs from the original discharge destination. Particularly, in a PP, there are two or more discharge destinations, and there is a high risk of a user failing to check which discharge destination is selected as the purge destination. As a result, a sheet left at the purge destination might mix with other printed materials, and be exposed to a third party.

SUMMARY OF THE INVENTION

Furthermore, in a PP, the sheet conveyance path is normally long, and a discharge destination far away from the original discharge destination might be selected as the purge destination. In this case, the risk of a user failing to remove purged sheets is even higher. Moreover, having to move from the original discharge destination to the purge destination to check the existence/non-existence of a purged sheet might impose an additional burden on the user.

An object of the present invention is to solve the above problems and provide an image forming apparatus that can avoid risk of a user failing to remove purged sheets even though there are two or more discharge destinations that can be used as purge destinations.

To achieve the abovementioned object, according to an aspect, an image forming apparatus reflecting one aspect of the present invention comprises: an operating unit configured to display an operation screen, and accept a user operation through the operation screen; a conveying unit configured to convey a sheet along a path to one of a plurality of discharge destinations, the path leading to the discharge destinations; an image forming unit configured to form an image on the sheet moving in the path; and a control unit configured to identify a conveyance destination from among the discharge destinations in accordance with the user operation accepted by the operating unit, and cause the conveying unit to convey the sheet to the conveyance destination, wherein, when a jam in the path is detected through the conveying unit, the control unit causes the conveying unit to suspend sheet conveyance, and causes the operating unit to display a select screen for selecting a purge destination from among the discharge destinations and accept a purge destination selected by a user through the select screen, and after the operating unit accepts the selected purge destination, the control unit identifies a sheet to be moved to the purge destination from among sheets staying in the path, and causes the conveying unit to convey the sheet to the purge destination.

The operating unit preferably displays the select screen as a pop-up on the operation screen.

The control unit preferably causes the conveying unit to leave remaining sheets among sheets staying in the path in the path, the remaining sheets excluding the sheet to be conveyed to the purge destination accepted by the operating unit, or causes the conveying unit to convey a movable sheet among the remaining sheets to a discharge destination to which the movable sheet can be conveyed among the discharge destinations.

The image forming apparatus preferably further comprises at least one post-processing unit configured to perform post-processing on a sheet moving on a downstream side of the image forming unit in the path. In this case, at least one of the discharge destinations is preferably assigned to each one of the at least one post-processing unit.

The control unit preferably selects a candidate purge destination from among the discharge destinations and displays the candidate purge destination on the select screen, in accordance with a location of the sheet processed first in a job among the sheets staying in the path.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

[Exterior of an Image Forming Apparatus]

Figure 1:
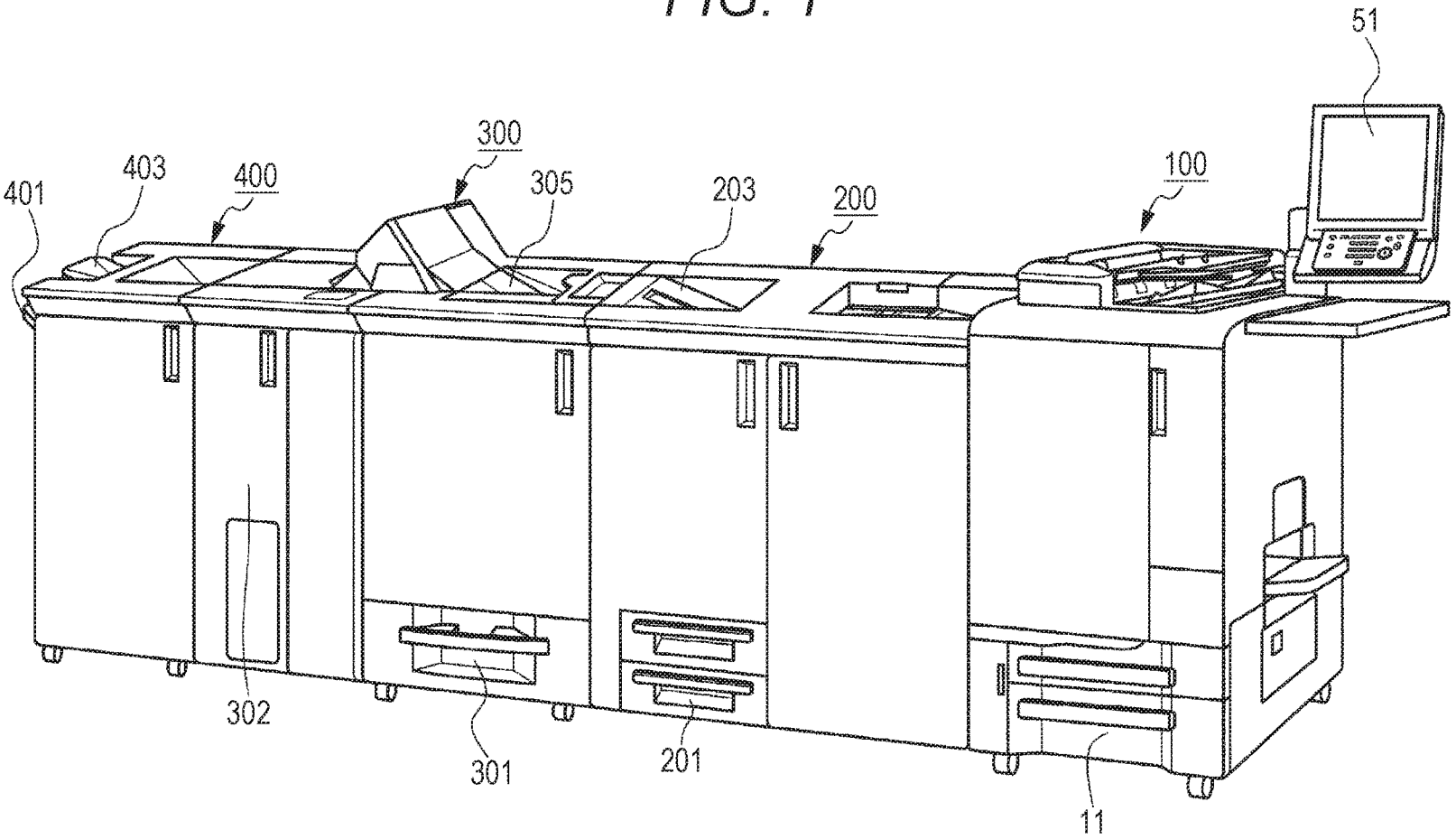
FIG. 1 is a perspective view of the exterior of an image forming apparatus according to an embodiment of the present invention.

FIG. 1 is a perspective view of the exterior of an image forming apparatus according to an embodiment of the present invention. As shown in FIG. 1, this image forming apparatus includes a main unit 100 and an external post-processing unit. The post-processing unit includes three cascade-connected machines: a saddle stitching machine 200, a case binding machine 300, and a side stitching machine 400.

The main unit 100 has the functions of a scanner, a copying machine, and a laser printer. As shown in FIG. 1, an automatic document feeder (ADF) 110 is attached to the upper surface of the housing of the main unit 100 in such a manner that the ADF 110 can be opened and closed. A scanner 120 is provided in an upper portion of the housing located immediately below the ADF 110, and a printer 130 is provided in a lower portion of the housing. A sheet feed cassette 131 is provided at a bottom portion of the printer 130 in such a manner that the sheet feed cassette 131 can be ejected from the printer 130. The ADF 110 feeds the scanner 120 with a document from the tray on the upper surface. The scanner 120 reads an image from the surface of the document. The printer 130 prints the image or the image represented by image data acquired from a network onto a sheet stored in the sheet feed cassette 131.

The saddle stitching machine 200 receives, from the main unit 100, sheets on which images have been printed by the printer 130, and bundles the sheets. The saddle stitching machine 200 then saddle-stitches the bundle, to form a booklet. A booklet tray 201 is provided at the bottom of the saddle stitching machine 200 in such a manner that the booklet tray 201 can be ejected from the saddle stitching machine 200, and completed booklets are stored in the booklet tray 201.

The case binding machine 300 receives, from the main unit 100 via the saddle stitching machine 200, sheets on which images have been printed by the printer 130, and bundles the sheets. The case binding machine 300 then performs a case binding process on the bundle. A cover tray 301 is provided at the bottom of the housing of the case binding machine 300 in such a manner that the cover tray 301 can be ejected from the case binding machine 300, and a wagon (not shown) is housed behind a front door 302 at the left end of the housing. Bundles processed into booklets are stacked on the wagon, and are pulled out with the wagon.

The side stitching machine 400 receives, from the main unit 100 via the saddle stitching machine 200 and the case binding machine 300, sheets on which images have been printed by the printer 130, and bundles the sheets. The side stitching machine 400 then side-stitches the bundle. A sheet catch tray 401 is attached to the left side surface of the side stitching machine 400. The side stitching machine 400 stacks each bundle of printed sheets received from the main unit 100 onto the sheet catch tray 401 after performing side stitching on the bundle or without performing side stitching.

[Sheet Conveyance Path]

Figure 2:
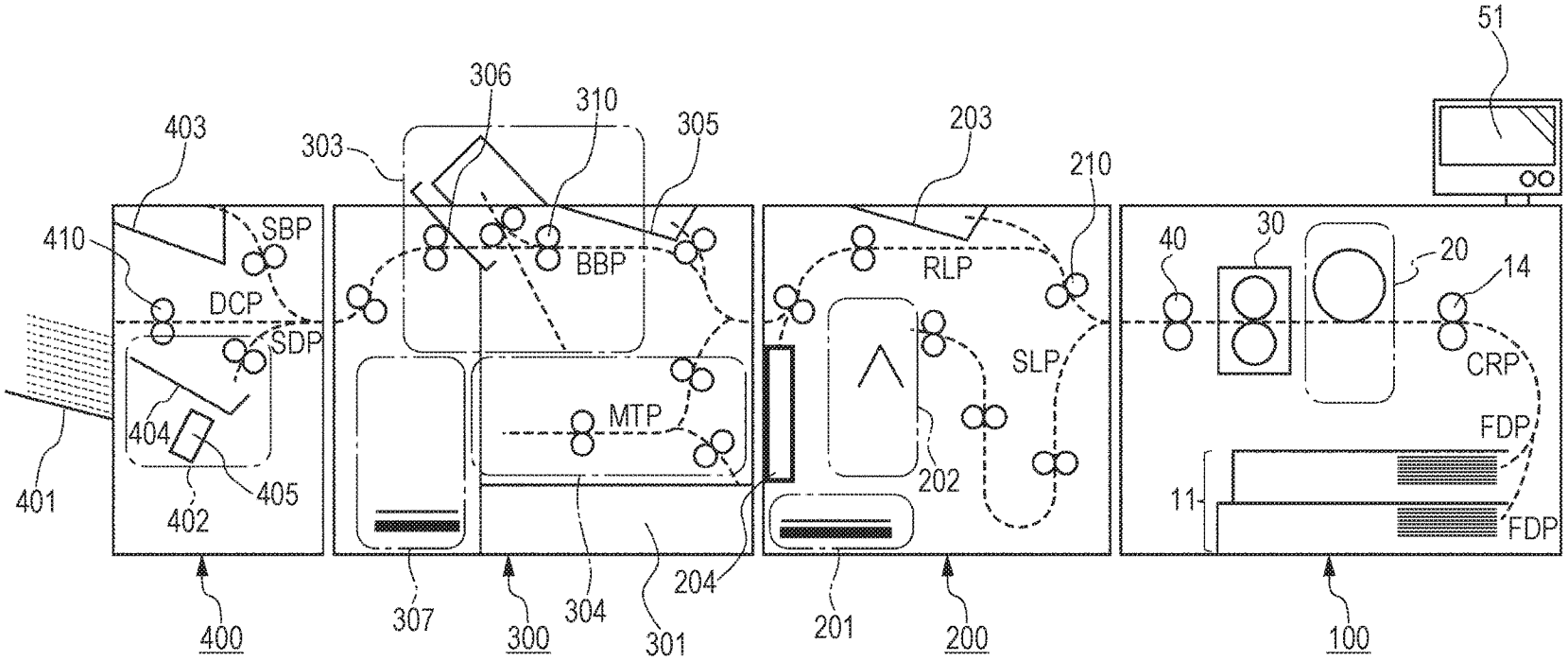
FIG. 2 is a schematic view of the sheet conveyance path in the image forming apparatus shown in FIG. 1.

FIG. 2 is a schematic view of the sheet conveyance path in the image forming apparatus shown in FIG. 1. As indicated by the dashed lines in FIG. 2, the conveyance path is designed as follows.

In the main unit 100, sheet feeding paths FDP extending from respective sheet feed cassettes 11 join a single conveyance path CRP. This conveyance path CRP penetrates an imaging unit 20 and a fixing unit 30, and further extends from an ejecting unit 40 to the conveyance path in the saddle stitching machine 200 in the next stage.

The conveyance path in the saddle stitching machine 200 branches into the two paths: a processing path SLP that penetrates a saddle stitching unit 202; and a relay path RLP leading to the conveyance path in the case binding machine 300 in the next stage. The processing path SLP has the booklet tray 201 at its end. The relay path RLP leads to a sub tray 203 provided on the upper surface of the saddle stitching machine 200, and to a purge tray 204 provided in the saddle stitching machine 200.

The conveyance path in the case binding machine 300 branches into the two paths: a relay path BBP that penetrates a collating unit 303 and leads to the conveyance path in the side stitching machine 400 in the next stage; and a processing path MTP that penetrates a covering unit 304. The relay path BBP leads to a sub tray 305 provided on the upper surface of the case binding machine 300, and to a stacking tray 306 provided in the collating unit 303. The processing path MTP has the cover tray 301 at its start, and has a wagon 307 at its end.

The conveyance path in the side stitching machine 400 branches into the three paths: a sheet discharge path DCP leading directly to the sheet catch tray 401; a processing path SDP leading to a side stitching unit 402; and a sub path SBP leading to a sub tray 403 provided on the upper surface of the side stitching machine 400. The processing path SDP has a processing tray 404 at its end. The processing tray 404 is provided in the side stitching unit 402.

As shown in FIG. 2, conveyance rollers 14, 210, 310, and 410 are provided in the path. Each pair of conveyance rollers guide a sheet sent out from the upstream conveyance rollers into their own nip, and then sends out the sheet to the downstream side. Although not shown in FIG. 2, motors for driving the respective pairs of conveyance rollers are provided around the path. Each motor is a direct-current brushless (BLDC) motor, for example, and applies rotative force to each corresponding pair of rollers through a transmission system such as gears and a belt.

At each branching point of the path shown in FIG. 2, a switching claw and a solenoid for driving the claw are provided (not shown in FIG. 2). The switching claw is a claw or plate-like member having its base end rotatably fixed. Using an electromagnet, the solenoid moves a moving core (a plunger) back and forth in the axial direction, to pull and push the switching claw. In this manner, the switching claw is made to swing around the base end. As the switching claw swings, the tip of the switching claw moves up and down. Thus, the path to the downstream side at the branching point is switched.

Although not shown in FIG. 2, optical sensors are further provided in the path. Each of the optical sensors senses a sheet passing through the installation site thereof. Specifically, each optical sensor includes a light emitting unit and a light receiving unit. The light emitting unit emits light at a predetermined wavelength, such as infrared light. The light receiving unit detects light at the predetermined wavelength. While one sheet is passing through the installation site of an optical sensor, the sheet blocks the light emitted from the light emitting unit before reaching the light receiving unit, or reflects the light toward the light receiving unit. Since the output of the light emitting unit varies depending on the blocking or reflection of the emitted light, the sheet passing through the installation site of the optical sensor is sensed. From the timing of the sensing, a conveyance defect caused by a jam or the like is detected.

[Internal Structure of the Main Unit]

Figure 3:
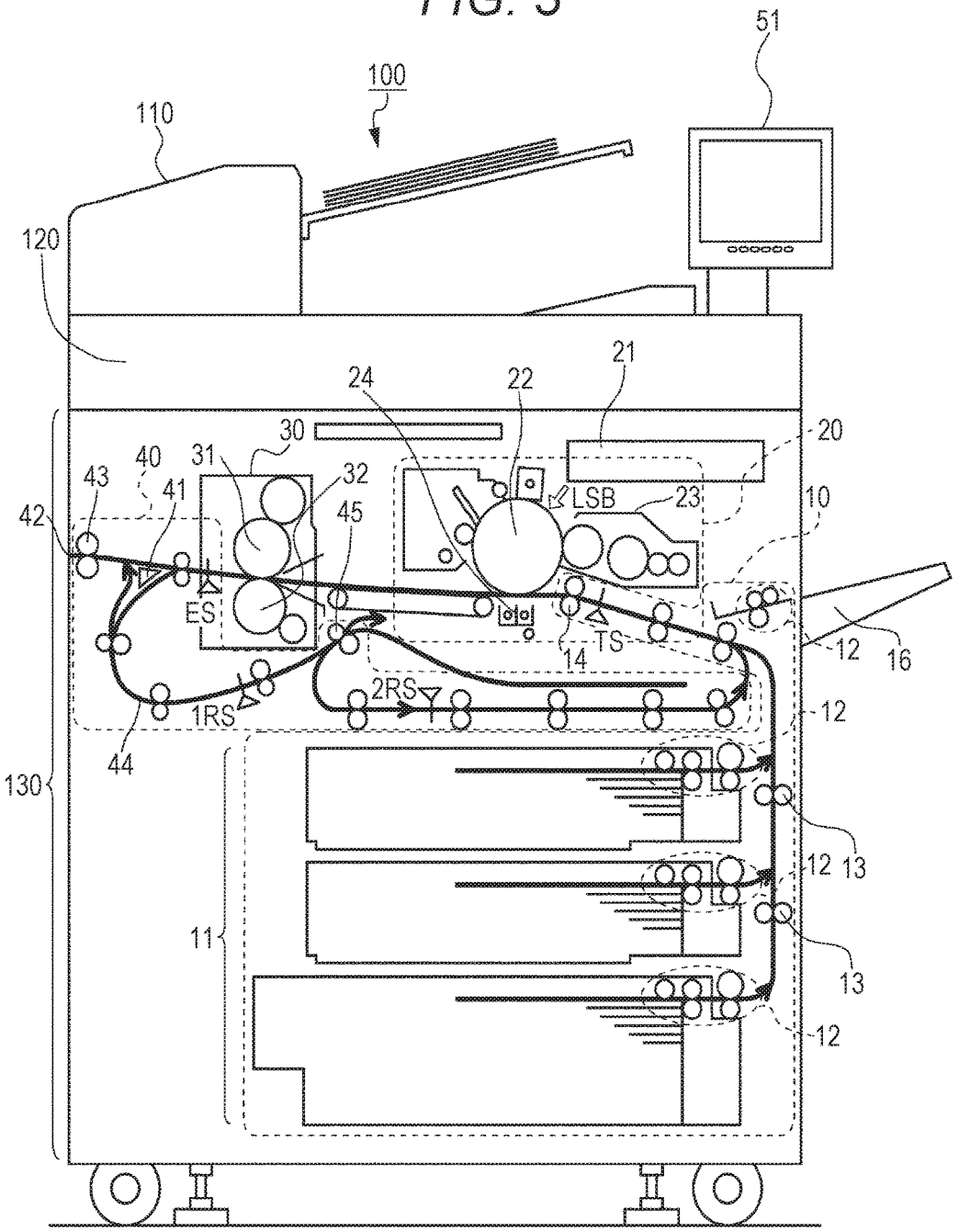
FIG. 3 is a schematic front view of the internal structure of the main unit of the image forming apparatus shown in FIG. 1.

FIG. 3 is a schematic front view of the internal structure of the main unit 100 of the image forming apparatus shown in FIG. 1. FIG. 3 shows the internal components as if the front side of the housing were transparent. As shown in FIG. 3, the printer 130 includes a feeding unit 10, the imaging unit 20, the fixing unit 30, and the ejecting unit 40. These components 10 through 40 cooperate with one another, and function as an image forming unit that forms an image with toner on a sheet in accordance with image data.

Using feed rollers 12, 13, and 14, the feeding unit 10 feeds the imaging unit 20 with sheets one by one from a bundle SHT of sheets stored in a sheet feed cassette 11 or a manual feed tray 16. The material of sheets that can be stored in the sheet feed cassettes 11 and the manual feed tray 16 is paper or resin, the size of the sheets is A3, A4, A5, B4, or the like, and the paper type is plain paper, high-quality paper, coated paper, or the like. Sheet feed sensors FS are provided in the vicinities of the sheet feed cassettes 11 and the manual feed tray 16. In accordance with whether there are delays in passing of sheets indicated by outputs from the sheet feed sensors FS, checks can be made to determine whether the feed rollers 12, 13, and 14 are sending sheets into the path at correct times.

The feeding unit 10 includes timing rollers 14 and a timing sensor TS in the vicinities of the boundary with the imaging unit 20. Since the timing rollers 14 are normally not moving, a sheet that has reached the site also comes to a temporary halt. The timing rollers 14 start rotating at the time indicated by a drive signal supplied from a principal control unit 60 described later. With this, a toner image formed on the surface of a photosensitive drum 22 comes into contact with a sheet sent out from the timing rollers 14 to the imaging unit 20 in a timely fashion, so that the toner image is appropriately transferred onto the sheet. In accordance with the sheet passing time indicated by the output of the timing sensor TS, a check is made to determine whether there is a sheet conveyance defect at the timing rollers 14 and the regions surrounding the timing rollers 14.

The imaging unit 20 forms a toner image on a sheet sent from the feeding unit 10. Specifically, an exposing unit 21 emits laser beams LSB onto the photosensitive drum 22, and exposes the surface of the photosensitive drum 22 in the pattern represented by image data. By doing so, the exposing unit 21 forms an electrostatic latent image on the surface of the photosensitive drum 22. A developing unit 23 then develops the electrostatic latent image with toner. By virtue of an electric field between the photosensitive drum 22 and an electrode 24 facing the surface of the photosensitive drum 22, the developed toner image is transferred from the surface of the photosensitive drum 22 onto the surface of the sheet passing being conveyed between the photosensitive drum 22 and the electrode 24.

The fixing unit 30 thermally fixes the toner image onto the sheet sent out from the imaging unit 20. Specifically, when a sheet is conveyed to the nip formed between a fixing roller 31 and a pressure roller 32, the fixing roller 31 applies the heat of its internal heater to the surface of the sheet, and the pressure roller 32 applies pressure to the heated portion of the sheet, to press the sheet against the fixing roller 31. With the heat from the fixing roller 31 and the pressure from the pressure roller 32, a toner image is fixed onto the surface of the sheet.

The ejecting unit 40 delivers the sheet sent out from the fixing unit 30 to the saddle stitching machine 200 in the next stage, or reverses and returns the sheet to the imaging unit 20. Specifically, the ejecting unit 40 first causes a switching claw 41 to swing around the base end thereof, to more the tip of the switching claw 41 up and down.

In a case where a sheet sent out from the fixing unit 30 is to be delivered to the saddle stitching machine 200, the electing unit 40 lowers the tip of the switching claw 41, to form a path to a sheet outlet 42. The sheet outlet 42 is a long, thin slit that is formed in a side surface of the housing of the main unit 100 and extends in the horizontal direction. A sheet moved from the switching claw 41 to the sheet outlet 42 is sent out from the sheet outlet 42 to the saddle stitching machine 200, as ejecting rollers 43 provided on the inner side of the sheet outlet 42 rotate.

In a case where a sheet sent out from the fixing unit 30 is to be delivered to a circulation path 44, the ejecting unit 40 lifts up the tip of the switching claw 41, to form a path to the circulation path 44. A sheet that enters the upstream portion of the circulation path 44 from the switching claw 41 is sent to reversing rollers 45 by conveyance rollers. The reversing rollers 45 can rotate both backward and forward. While rotating forward, the reversing rollers 45 sends out the sheet to a reversal guide 46 with their circumferential surfaces. Immediately before the bottom of the sheet passes through the reversing rollers 45, the reversing rollers 45 rotate backward, to pull the sheet out of the reversal guide 46 and send out the sheet to the downstream portion of the circulation path 44. As the reversing rollers 45 reverse the sheet in this manner, the sheet now facing down is returned into the path in the feeding unit 10. The feeding unit 10 then sends the sheet again to the imaging unit 20, and the imaging unit 20 forms a toner image on the back surface of the sheet. The fixing unit 30 thermally fixes the toner image onto the sheet, and the ejecting unit 40 sends out the sheet to the saddle stitching machine 200 this time.

A sheet ejection sensor ES is provided in front of the switching claw 41. In accordance with whether there is a delay in passing of a sheet indicated by an output from the sheet ejection sensor ES, a check can be made to determine whether the sheet is passing through the switching claw 41 at the right time. Reversal sensors 1RS and 2RS are provided in the circulation path 44. In accordance with whether there are delays in passing of a sheet indicated by outputs from the reversal sensors 1RS and 2RS, a check can be made to determine whether the reversing rollers 45 have reversed the sheet at the right time.

[Electronic Control System of the Main Unit]

Figure 4:
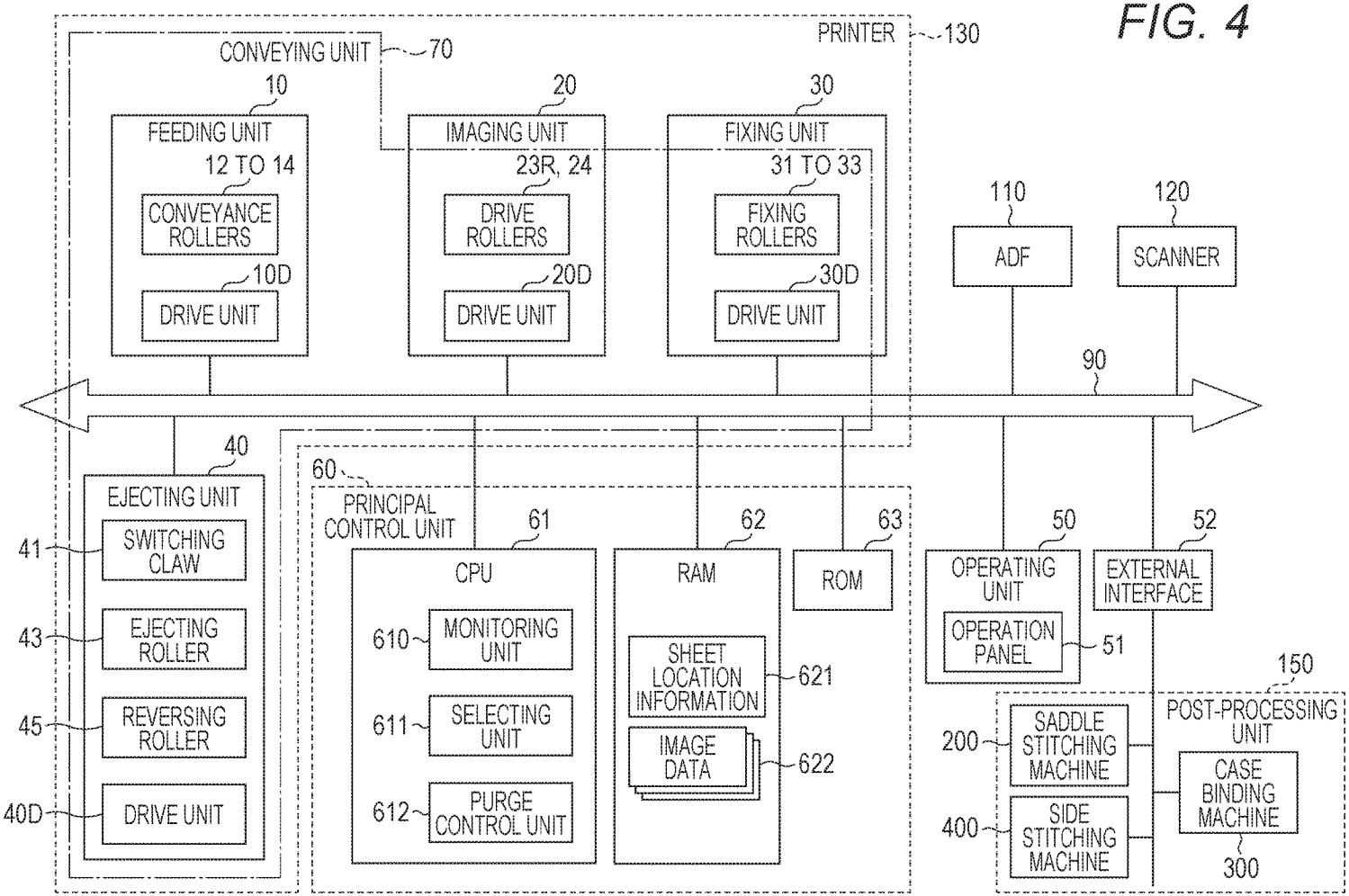
FIG. 4 is a block diagram of the electronic control system in the main unit shown in FIG. 3.

FIG. 4 is a block diagram of the electronic control system of the main unit 100. As shown in FIG. 4, in this electronic control system, an operating unit 50, an external interface 52, and the principal control unit 60, as well as the ADF 110, the scanner 120, and the printer 130, are connected to one another via a bus 90, so that these components can communicate with one another. Particularly, in the printer 130, the feeding unit 10, the ejecting unit 40, and part of the imaging unit 20 and the fixing unit 30 constitute a conveying unit 70 using the bus connection.

—Operating Unit—

Through a user operation or communication with an external electronic device, the operating unit 50 receives a job request and print image data, and transfers the request and the image data to the principal control unit 60. As shown in FIG. 4, the operating unit 50 includes an operation panel 51. The operation panel 51 is provided on the upper surface of the housing of the main unit 100 as shown in FIG. 1, and includes push buttons, a touch panel, and a display. The operating unit 50 controls the operation panel 51 to display an operation screen and a GUI screen such as an input screen for various parameters on the display. The operating unit 50 also identifies the location (s) of the push button (s) or the touch panel operated by the user, and transmits information about the identification as operation information to the principal control unit 60.

—External Interface—

The external interface 52 includes a USB port or a memory card slot, and obtains print image data directly from an external storage device such as a USB memory or a hard disk drive (HDD) inserted into the USB port or the memory card slot. The external interface 52 is also connected to an external network (not shown in FIG. 4) in a wired or wireless manner, and receives the print image data from another electronic device in the external network. The external interface 52 is further connected to the electronic control system of a post-processing unit 150, and relays data between the electronic control system and the principal control unit 60.

—Conveying Unit—

The conveying unit 70 is the entire functional unit that conveys sheets in the main unit 100. As can be seen from FIGS. 3 and 4, the conveying unit 70 includes part of the Imaging unit 20 and the fixing unit 30, such as the photosensitive drum 22, the fixing roller 31, and the pressure roller 32, as well as the feeding unit 10 and the ejecting unit 40.

As shown in FIG. 4, the respective components 10, 20, 30, and 40 of the printer 130 includes drive units 10D, 20D, 30D, and 40D, respectively. The respective drive units 10D, 20D, 30D, and 40D control the drive motors and solenoids of the conveyance rollers 12, 13, and 14, and various movable members in the conveying unit 70. Using various kinds of sensors, the respective drive units 10D, 20D, 30D, and 40D further monitor the operating states of the respective components 10, 20, 30, and 40 of the main unit 100 and the sheet conveyance state. If a problem is detected, the drive unit that has detected the problem notifies the principal control unit 60 of the problem. The sensors used in the monitoring include the optical sensors FS and the others shown in FIG. 3, the position sensors for sensing the positions or the postures of the movable members such as the photosensitive drum 22 and the fixing roller 31, the sensors for sensing running out of paper in the sheet feed cassettes 11, and the sensor for sensing a shortage of toner in the developing unit 23.

—Principal Control Unit—

The principal control unit 60 is an electronic circuit mounted on a single substrate, and the substrate is provided in the main unit 100. As shown in FIG. 4, the principal control unit 60 includes a CPU 61, a RAM 62, and a ROM 63. In accordance with firmware, the CPU 61 controls the other components 10 and 20 and others connected to the bus 90. The RAM 62 provides the CPU 61 with the work area for executing the firmware. Into the work area, the CPU 61 writes sheet location information 621 to be used in a sheet conveyance process, for example. The RAM 62 stores print image data 622 received by the operating unit 50. This image data 622 is expressed in a page description language (PDL), for example. The ROM 63 includes an unwritable semiconductor memory device, and a rewritable semiconductor memory device such as an EEPROM, or an HDD. The former stores the firmware, and the latter provides the CPU 61 with the storage area for saving environment variables and the like.

As the CPU 61 executes various kinds of firmware, the principal control unit 60 controls the other components in the main unit 100 in accordance with operation information supplied from the operating unit 50. Specifically, the principal control unit 60 causes the operating unit 50 to display the operation screen to accept an operation from the user. In accordance with this operation, the principal control unit 60 determines an operation mode, such as an activated mode, a standby mode, or a sleep mode. The principal control unit 60 then notifies the other components of the determined operation mode in the form of a drive signal, and causes each component to perform a process in the operation mode.

For example, when the operating unit 50 receives a job from the user, the principal control unit 60 first causes the operating unit 50 to transfer the print image data 622 to the RAM 62. The principal control unit 60 then notifies the feeding unit 10 of the type of sheet to be supplied and the timing of the supply, in accordance with the print requirements indicated by the image data 622. The principal control unit 60 provides the imaging unit 20 with the image data indicating the toner image to be formed. The principal control unit 60 notifies the fixing unit 30 of the surface temperature for the fixing roller 31 to maintain. The principal control unit 60 notifies the ejecting unit 40 of the orientation of the tip of the switching claw 41, and the timing of switching. The principal control unit 60 also notifies the post-processing unit 150 of the timing of ejection of a sheet from the ejecting unit 40, and the type of the post-processing to be performed on the sheet.

The principal control unit 60 further monitors the operating states of the image forming units 10 through 40 and the post-processing unit 150, or particularly, the states of sheet conveyance being performed by those components. If a problem is detected from one of those components, the principal control unit 60 appropriately changes the operation mode, to solve the problem. For example, in a case where an abnormal delay in sheet conveyance is sensed by one of the optical sensors FS and the others shown in FIG. 3, the printer 130 and the post-processing unit 150 are made to suspend the processing, and the operation panel 51 is made to display a message "a paper jam has occurred", to prompt the user to solve the problem. In a case where running out of paper in a sheet feed cassette 11 or a shortage of toner in the developing unit 23 of the imaging unit 20 is sensed, the printer 130 is made to suspend the processing, and the operation panel 51 is made to display a message "paper has run out/toner is running short", to prompt the user to replenish it.

As shown in FIG. 4, the principal control unit 60 includes a monitoring unit 610, a selecting unit 611, and a purge control unit 612. These functional units 610, 611, and 612 are designed for controlling the purge process to be performed by the conveying unit 70 and the post-processing unit 150, and are realized by the CPU 61 executing special-purpose firmware.

While the conveying unit 70 of the main unit 100 and the post-processing unit 150 are conveying sheets along the path, the monitoring unit 610 monitors the locations of the sheets through the outputs from the optical sensors FS and the others shown in FIG. 3, and, in accordance with the locations, controls the sheet conveying operation being performed by the conveying unit 70 and the post-processing unit 150.

The selecting unit 611 is activated when the monitoring unit 610 detects a jam in the path through the conveying unit 70 and the post-processing unit 150. The selecting unit 611 causes the user to select a purge destination from among the discharge destinations in the main unit 100 and the post-processing unit 150, using the operating unit 50. Specifically, the selecting unit 611 first causes the conveying unit 70 and the post-processing unit 150 to suspend the sheet conveyance. At the same time, the selecting unit 611 causes the operating unit 50 to display the select screen for selecting a purge destination from among the discharge destinations, and receive the purge destination selected by the user through the select screen.

When the operating unit 50 receives the purge destination from the user, the purge control unit 612 is activated. The purge control unit 612 identifies the sheet(s) that can be moved to the purge destination among the sheets staying in the path, and causes the conveying unit 70 and the post-processing unit 150 to convey the sheet(s) to the purge destination.

The purge process to be controlled by these functional units 610, 611, and 612 will be described later in detail.

[Structure of the Saddle Stitching Machine]

Figure 5A:
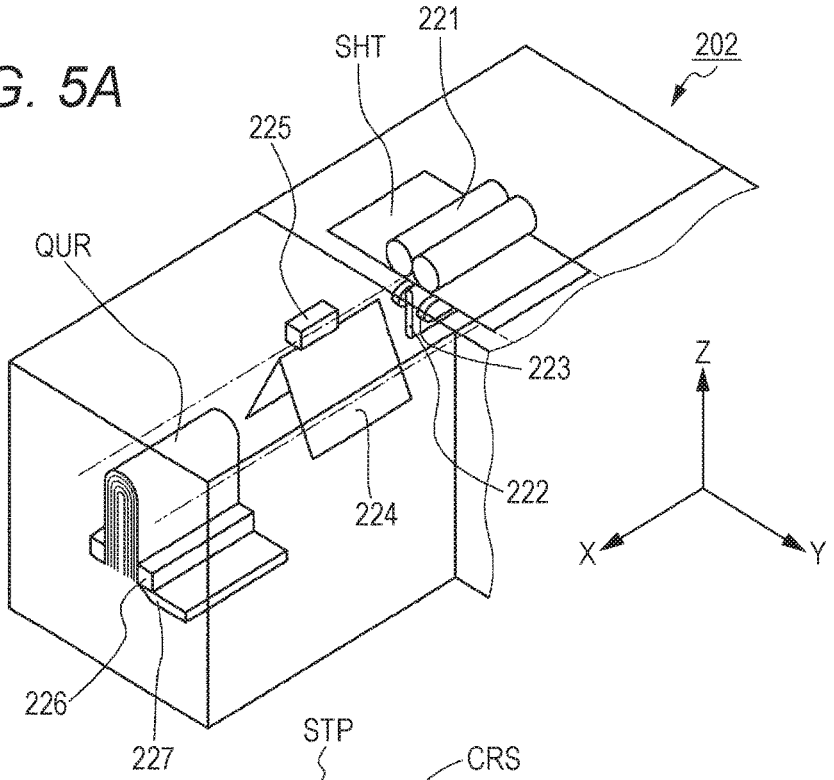
FIG. 5A is a schematic diagram showing the principal structure of the saddle stitching machine shown in FIG. 1.

FIG. 5A is a schematic diagram showing the structure of a saddle stitching unit 202 that is the principal part of the saddle stitching machine 200. As shown in FIG. 5A, the saddle stitching unit 202 includes folding rollers 221, a folding plate 222, conveyance belts 223, a stacking saddle 224, a stapler 225, holding members 226, and a cutter 227. A saddle stitching process involving these components includes the following three steps in this order: (A) folding in the middle, (B) binding with staples, and (C) end cutting.

(A) The folding rollers 221 and the folding plate 222 are used in the folding step. The folding rollers 221 are a pair of identical rollers having a long, thin cylindrical shape. The folding rollers 221 are adjacent to each other, with their rotary shafts being parallel to each other. A nip is formed between the folding rollers 221 in such positions. The folding rollers 221 can rotate both backward and forward. The folding plate 222 is a thin blade-like or wedge-shaped member. The folding plate 222 is placed in a virtual plane (the X-Z plane in FIG. 5A) including the nip of the folding rollers 221 in such a manner that the tip of the blade or the wedge faces the nip of the folding rollers 221. The folding plate 222 can be inserted into and pulled out of the nip. The conveyance belts 223 are provided one each on the front side and the back side of the folding plate 222. The conveyance belts 223 are brought into contact with a sheet SHT inserted between the folding rollers 221 and the folding plate 222, and convey the sheet SHT in the axial direction (the X-axis direction in FIG. 5A) of the folding rollers 221.

In the folding step, the sheet SHT to be folded in the middle is inserted between the folding rollers 221 and the folding plate 222, and the straight portion to be folded is placed in a virtual plane (the X-Z plane) including the nip of the folding rollers 221 and the folding plate 222. The tip of the folding plate 222 is then inserted together with the sheet SHT into the nip of the folding rollers 221, and the folding rollers 221 rotate forward, to pull the straight portion to be folded of the sheet SHT into the nip, using the circumferential surfaces thereof. At the time when a predetermined width having the straight portion of the sheet SHT at its center is pulled into the nip, the tip of the folding plate 222 is pulled out of the nip, and the folding rollers 221 rotate backward, to remove the sheet SRI out of the nip. As a result, the straight portion of the sheet SHT has a crease, and this sheet SHT becomes a "fold". After that, this fold is pushed (in the X-axis direction in FIG. 5A) onto the stacking saddle 224 by the conveyance belts 223.

(B) The stacking saddle 224 and the stapler 225 are used in the binding step. The stacking saddle 224 is formed by combining two plate-like members into a member in the shape of a gabled roof, and collation is performed on the member. Specifically, folds formed in the folding step are stacked on the stacking saddle 224 in the order of formation, so that the creases are positioned at the "ridge" of the stacking saddle 224. When a bundle of folds equivalent to one booklet are stacked on the stacking saddle 224, the stapler 225 puts staples from the top of the bundle toward the ridge of the stacking saddle 224. A clincher (not shown in FIG. 5A) is buried in the ridge, and the clincher bends and flattens the edges of the stables put by the stapler 225. In this manner, the bundle on the stacking saddle 224 is bound up, and a quire is completed. After that, the quire is pushed from the stacking saddle 224 in the ridge direction (the X-axis direction shown in FIG. 5A), and moves between the holding members 226.

(C) The holding members 226 and the cutter 227 are used in the cutting step. The holding members 226 are a pair of stick-like members. The holding members 226 are arranged parallel to each other, with a distance being maintained in between. The holding members 226 can be translated in a direction (the Y-axis direction in FIG. 5A) perpendicular to the longitudinal direction (the X-axis direction in FIG. 5A) so that the distance changes. The cutter 227 has a blade that can move between the holding members 226. A quire QUR that has moved from the upper surface of the stacking saddle 224 into the gap between the holding members 226 is held at both sides by the holding members 226. The cutter 227 moves its blade in this situation, and cuts the end of the quire QUR protruding from the gap between the holding members 226. One booklet is completed in this manner, and is stored in the booklet tray 201 shown in FIG. 2.

Figure 5B:
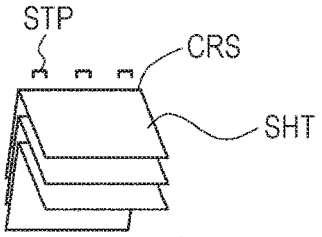
FIG. 5B is a schematic diagram showing the saddle stitching method implemented by the saddle stitching machine.
Figure 5C:
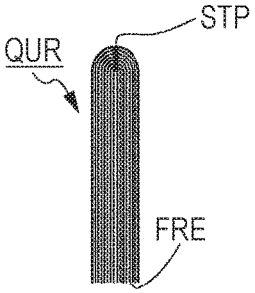
FIGS. 5C and 5D are a top view and a perspective view of a bundle of sheets processed by the saddle stitching machine.
Figure 5D:
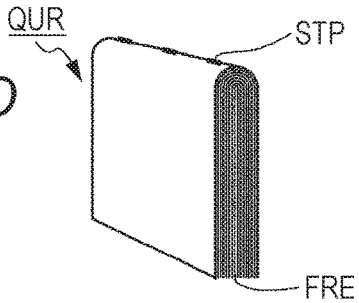

FIG. 5B is an exploded view of the quire QUR bound up on the stacking saddle 224. FIGS. 5C and 5D are a top view and a perspective view of the quire QUR after the cutting, or a booklet. The folds SHT are stacked so that the creases CRS are laid on top of one another. The creases CRS are bound up at two portions with stables STP. After the cutting by the cutter 227, the end FRE of the quire QUR becomes flat.

[Structure of the Case Binding Machine]

Figure 6A:
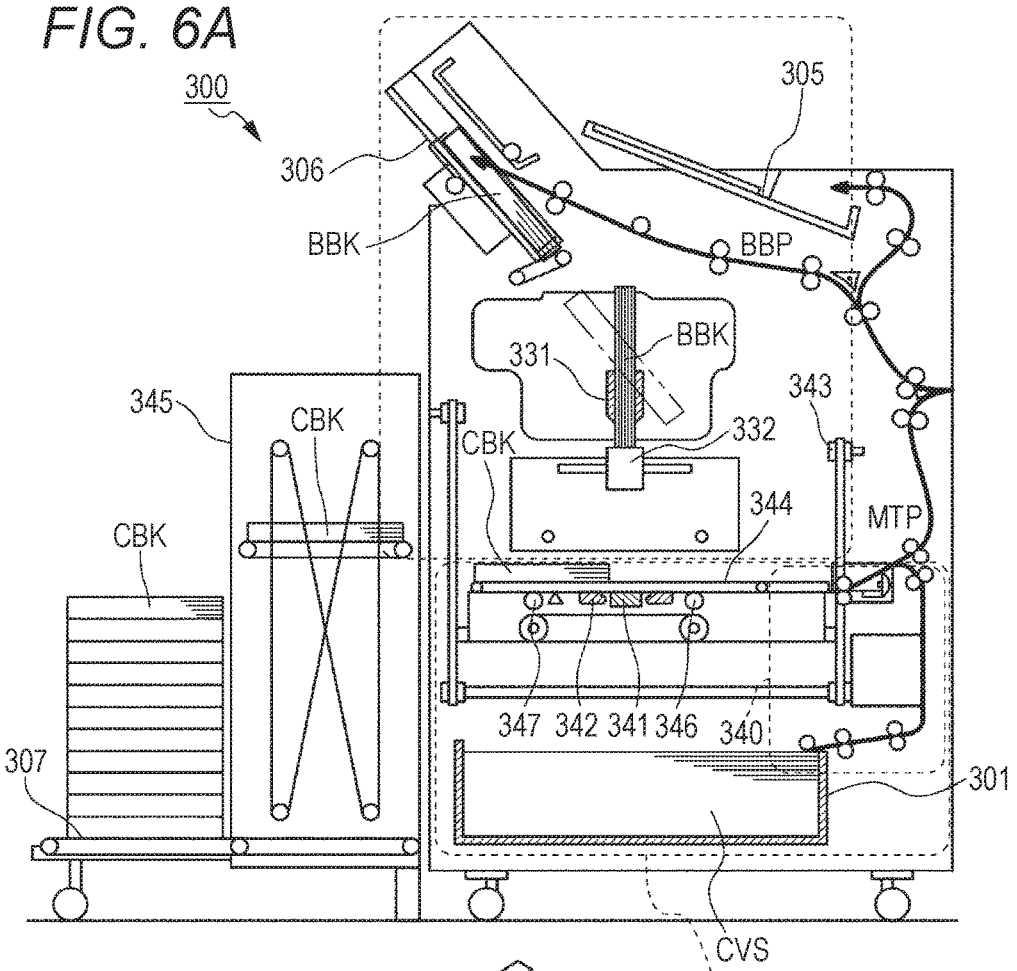
FIG. 6A is a schematic diagram showing the principal structure of the case binding machine shown in FIG. 1.

FIG. 6A is a schematic diagram showing the principal structure of the case binding machine 300. As shown in FIG. 6A, the collating unit 303 includes a grip member 331 and an adhesive applying unit 332, in addition to the stacking tray 306. The covering unit 304 includes a cover feeding unit 340, a pressure member 341, bending members 342, a lifting unit 343, a conveyance belt 344, and a placement unit 345, in addition to the cover tray 301 and the wagon 307.

—Collating Unit—

The collating unit 303 binds up sheets of one booklet and applies an adhesive to the spine of the bundle as described below. The stacking tray 306 is a tray provided at the end of one branch of the relay path BBP. The placement surface of the stacking tray 306 is tilted with respect to the horizontal direction. The grip member 331 is a manipulator that can move in a work space formed in the housing of the case binding machine 300. When a bundle BBK of sheets equivalent to one booklet are stacked on the stacking tray 306 via the relay path BBP, the grip member 331 grips the bundle BBK, and moves the bundle BBK from the stacking tray 306 into a space in front of the adhesive applying unit 332 (on the front side of the plane of FIG. 6A). The grip member 331 further stands and holds the bundle BBK vertically, with the spine of the bundle BBK facing down, as shown in FIG. 6A. The adhesive applying unit 332 moves back and forth (perpendicularly to the plane of FIG. 6A) in the front space, to roll an internal application roller (not shown in FIG. 6A) on the spine of the bundle BBK. With this, an adhesive such as a polyurethane (PUR)-based hot-melt adhesive is applied to the spine of the bundle BBK from the circumferential surface of the application roller.

—Covering Unit—

Figure 6B:
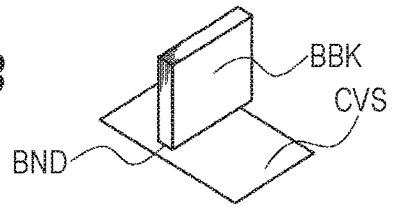
FIGS. 6B, 6C, and 6D are schematic diagrams showing a binding method implemented by the case binding machine.
Figure 6C:
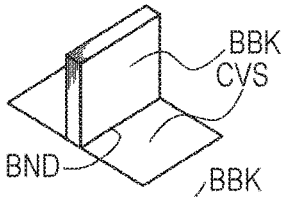
Figure 6D:
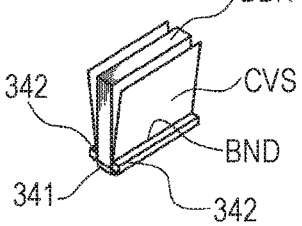

The covering unit 304 provides a cover to the bundle BBK of sheets collated by the collating unit 303. FIGS. 6B, 6C, and 6D are schematic diagrams showing the procedures in this step.

As shown in FIG. 6A, the cover feeding unit 340 separates covering sheets CVS one by one from the cover tray 301, using conveyance rollers provided along the processing path MTP. The cover feeding unit 340 then conveys each covering sheet CVS onto cover supporting rollers 346 and 347 through the processing path MTP. The pressure member 341 and the bending members 342 are provided between these rollers 346 and 347. When a covering sheet CVS is located on those components 341, 342, 346, and 347, the lifting unit 343 lifts up all those components and the covering sheet CVS in the vertical direction (the upward direction in FIG. 6A). With this lift, the covering sheet CVS moves closer from below to the spine of the bundle BBK held by the grip member 331, as shown in FIG. 6B.

As the lifting unit 343 continues to rise, a band-like portion at the middle of the covering sheet CVS is brought into contact with the spine of the bundle BBK, and the pressure member 341 presses the band-like portion against the spine of the bundle BBK, as shown in FIG. 6C. Since the adhesive has been applied to the spine, the band-like portion at the middle of the covering sheet CVS in contact with the spine is bonded to the spine.

As the lifting unit 343 further continues to rise, the pressure member 341 pushes the spine of the bundle BBK upward, and the bending members 342 are lifted up. As shown in FIGS. 6A and 6D, the bending members 342 are a pair of stick-like members that are arranged parallel to each other, and have the pressure member 341 in between. As the bending members 342 are lifted up, the portions of the covering sheet CVS adjacent to both sides of the band-like portion in contact with the spine of the bundle BBK are pressed against the spine-side ends of the first and last pages of the bundle BBK, or against the "gutters". As a result, the covering sheet CVS is bent along the rims of the spine of the bundle BBK, to cover the first and last pages of the bundle BBK, as shown in FIG. 6D. In this manner, one booklet CBK is completed.

Referring back to FIG. 6A, the grip member 331 lays down the booklet CBK on the conveyance belt 344. The conveyance belt 344 conveys the booklet CBK in the horizontal direction (the transverse direction in FIG. 6A), and sends out the booklet CBK to the placement unit 345. The placement unit 345 places the booklet CBK on the wagon 307.

[Structure of the Side Stitching Machine]

Referring back to FIG. 2, the processing tray 404 in the side stitching unit 402 is tilted with respect to the horizontal direction (the transverse direction in FIG. 2). When a bundle of sheets that have been obtained from the main unit 100 and are to be side-stitched are placed on the tray 404, the bundle is aligned by virtue of the tilt of the placement surface. Furthermore, as a stapler 405 is provided at the lower edge of the tilt of the tray 404, the lower edge of the tilt of the aligned bundle is bound with staples. In this manner, the bundle on the processing tray 404 is bound up, and one booklet is completed. After that, the booklet is ejected from the processing tray 404 onto the sheet catch tray 401.

[Purge Process]

—Initial Settings—

The principal control unit 60 causes the operating unit 50 to accept the settings of the items shown below, for example, as the initial settings related to a purge process from the user (see JP 2014-164011 A, for example). (1) Whether a purge process is to be performed when a conveyance defect such as a jam occurs. (2) Whether to perform the purge process in an automatic mode, and whether to perform the purge process in a manual mode. That is, whether the purge process is to be started when a jam or the like is detected, or whether to make the user to confirm allowance/rejection of the purge process. (3) Whether a purge destination is to be fixed, or whether a purge destination is to be selected each time, in a case where the purge process is performed. (4) Which a discharge destination is to be selected as the purge destination in a case where a purge destination is fixed. (5) Which one of the following conditions is to be selected as the condition for selecting a purge destination in a case where the purge process is automatically performed and a purge destination is selected each time. (i) The purge destination is located at the most downstream location among the discharge destinations to which even one of the sheets remaining in the path can be conveyed. (ii) The purge destination is the discharge destination closest to the site where the frequency of occurrence of a jam according to the history is the highest, among the discharge destinations located on the upstream side of the site with the highest frequency of occurrence of a jam. (iii) The purge destination differs from the original discharge destination specified by the job.

When the image forming apparatus is activated, or the like, the operating unit 50 displays the GUI screen for setting these items on the operation panel 51, and prompts the user to set the respective items. When the user presses an "OK" button or the like, the operating unit 50 notifies the principal control unit 60 of information that has been received from the user and indicates the settings of the respective items. In accordance with the notification, the principal control unit 60 stores the information into the ROM 63.

—Monitoring Unit—

While the conveying unit 70 of the main unit 100 and the post-processing unit 150 (hereinafter referred to simply as the "conveying unit 70 and the like") convey sheets along the path, the monitoring unit 610 controls the drive unit 10D through 40D of the conveying unit 70 and the like described below in accordance with the operation mode of the image forming apparatus and the printing condition specified by the job.

The monitoring unit 610 first notifies each drive unit of the sheet conveyance destination and the timing to move a sheet to the conveyance destination. For example, the drive unit 10D of the feeding unit 10 is notified of the sheet feed cassette or the like to be selected as the sheet supplier, the timing for the feed rollers 12 to pick up a sheet from the selected sheet feed cassette or the like, and the timing for the timing rollers 14 to send out the sheet to the imaging unit 20. The drive unit 40D of the ejecting unit 40 is notified of the orientation of the tip of the switching claw 41 and the timing to switch the orientation, and the timing for the reversing rollers 45 to switch its rotation from forward rotation to backward rotation.

While the conveying unit 70 and the like convey sheets in accordance with these instructions, the monitoring unit 610 monitors outputs of the optical sensors FS and the others sent from the respective drive units 10D through 40D, and follows the location of each sheet in the path. Specifically, the monitoring unit 610 measures, with a timer, the time elapsing from the time when a conveyance roller sends out a sheet. Since the sheet conveyance speed is set at a standard value (or a system speed) in each operation mode, the monitoring unit 610 calculates the movement distance of each sheet every several tens to several hundreds of milliseconds, for example, in accordance with the standard conveyance speed and the time elapsing from the feed time. The monitoring unit 610 detects the current location of the sheet from the calculated distance. The monitoring unit 610 stores information about the location of each sheet detected in this manner as the sheet location information 621 into the RAM 62. In accordance with the location information 621, the monitoring unit 610 predicts the installation site of an optical sensor FS or the like through which a sheet is to pass next, and the time when the sheet is to pass through the location. In accordance with the difference between the predicted time and the actual time indicated by the output of the optical sensor, the monitoring unit 610 corrects the current location of the sheet, and updates the location information 621 with the corrected value. Using the updated location information 621, the monitoring unit 610 further notifies each drive unit of the new sheet conveyance destination and the new timing to move the sheet to the new conveyance destination.

In accordance with the sheet location information 621 and the outputs of the optical sensors FS and the others, the monitoring unit 610 also senses an abnormal delay in conveyance of a sheet due to a conveyance defect such as a jam. When an abnormal delay is sensed, the difference between the time at which the sheet is to pass through the installation site of an optical sensor FS or the like predicted from the sheet location information 621 and the actual time at which the sheet is to pass through the installation site in accordance with the output of the optical sensor exceeds the allowable range, or the output of the optical sensor does not indicate the actual time at which the sheet is to pass through the installation site even though the time elapsing from the predicted time exceeds the allowable range. The allowable range is set beforehand in accordance with variation in the time required for the conveying unit 70 and the like to move a sheet from the installation site of an optical sensor FS to the installation site of the next optical sensor.

—Selecting Unit—

The selecting unit 611 is activated when the monitoring unit 610 detects a jam. The selecting unit 611 first causes the conveying unit 70 and the like to suspend the sheet conveyance, and reads the initial settings related to the purge process from the ROM 63. If the initial settings indicate that the purge process is not to be performed due to a conveyance defect such as a jam, the selecting unit 611 only instructs the operating unit 50 to display a message or the like indicating that a jam has been detected.

In a case where the initial settings indicate that the purge process is to be performed, the selecting unit 611 determines from the initial settings in which mode the purge process is to be performed between the automatic mode and the manual mode. If the purge process is to be performed automatically, the selecting unit 611 further determines whether a purge destination is fixed, or whether a purge destination should be selected each time. If a purge destination is fixed, the selecting unit 611 extracts the identification information indicating the fixed purge destination from the initial settings. If a purge destination should be selected each time, the selecting unit 611 selects a purge destination in accordance with the selecting condition indicated by the initial settings. The selecting unit 611 then activates the purge control unit 612, and notifies the purge control unit 612 of the purge destination.

In a case where the initial settings indicate a purge process in the manual mode, the selecting unit 611 causes the user to check allowance/rejection of the purge process. Specifically, the selecting unit 611 first causes the operating unit 50 to display a purge destination select screen in the form of a pop-up.

Figure 7:
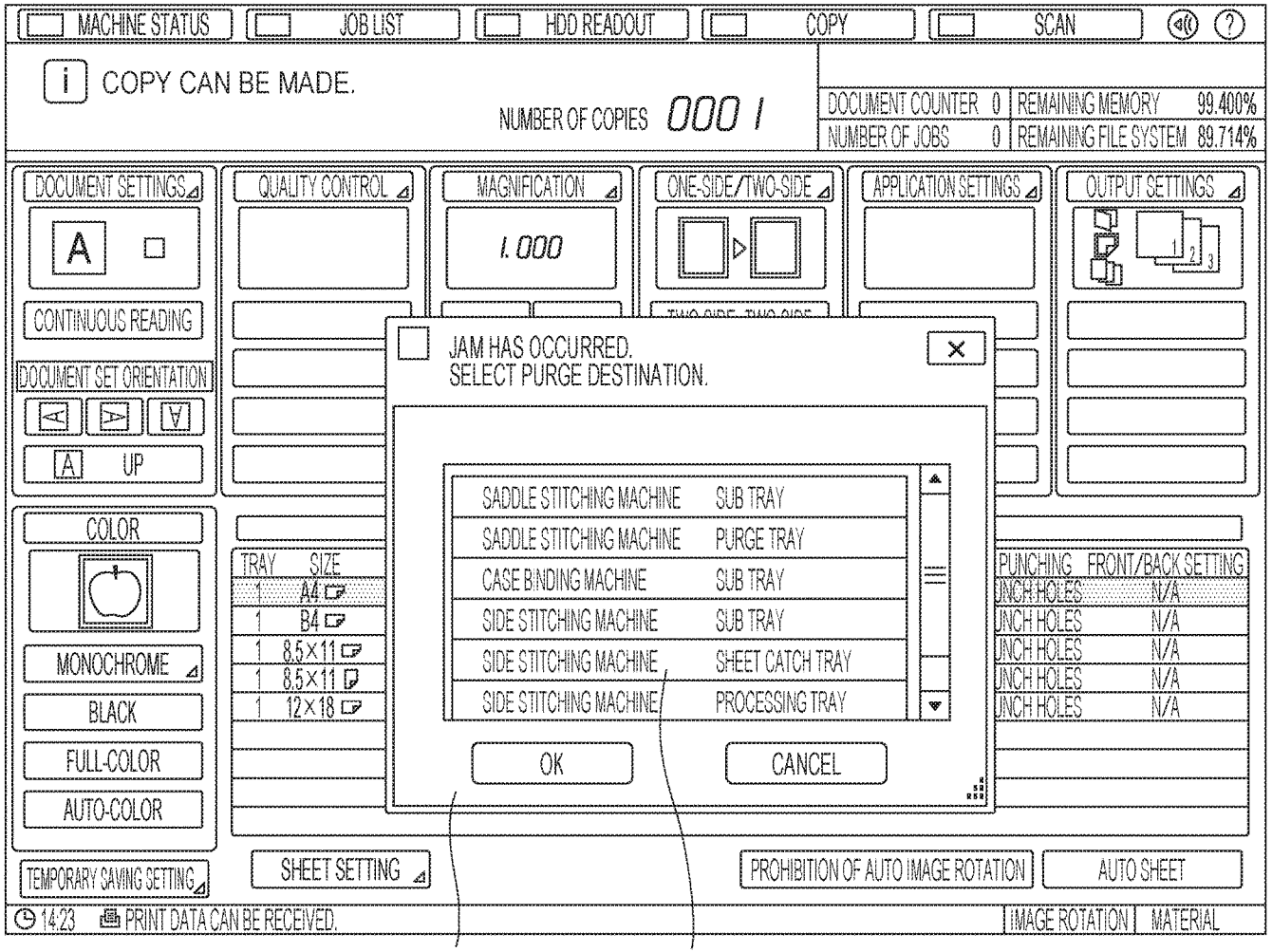
FIG. 7 is a diagram showing the purge destination select screen superimposed on the operation screen displayed by the operating unit shown in FIG. 1 when a jam is detected.

FIG. 7 shows this select screen 710. As shown in FIG. 7, the select screen 710 appears as a pop-up on an operation screen 700 displayed on the operation panel 51 when a jam is detected. The select screen 710 includes a menu 711, a cancel button 712, and an OK button 713. This menu 711 shows a list of discharge destinations in the image forming apparatus as purge destination options. In the example shown in FIG. 2, the discharge destinations include the sub tray 203 and the purge tray 204 in the saddle stitching machine 200, the sub tray 305 in the case binding machine 300, and the sheet catch tray 401 and the sub tray 403 in the side stitching machine 400. The cancel button 712 is pressed to reject a purge process. The OK button 713 is pressed to allow a purge process.

When the operating unit 50 senses that the cancel button 712 is pressed, the operating unit 50 notifies the selecting unit 611 that the user has rejected the purge process. In response to this notification, the selecting unit 611 instructs the operating unit 50 to indicate detection of a jam and display a message or the like to prompt the user to remove the remaining sheets from the entire path.

When the operating unit 50 senses that the OK button 713 is pressed, the operating unit 50 identifies the discharge destination selected by the user from the user operation performed on the menu 711, and notifies the selecting unit 611 of the discharge destination. In response to this notification, the selecting unit 611 activates the purge control unit 612, and notifies the purge control unit 612 of the purge destination that is the discharge destination sent from the operating unit 50.

—Purge Control Unit—

After activated, the purge control unit 612 first refers to the sheet location information 621, to identify each sheet that can be moved to the purge destination among the sheets remaining in the path, and determine the order of conveyance of the sheets. The purge control unit 612 then causes the conveying unit 70 and the like to convey the sheets to the purge destination in the determined order of conveyance.

Figure 8A:
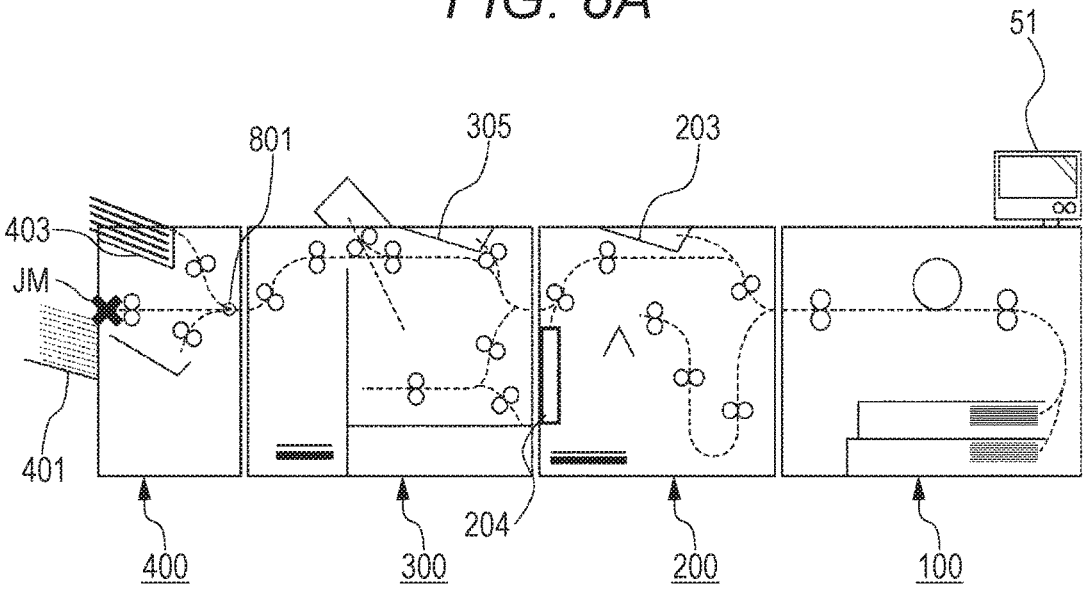
FIGS. 8A and 8B are schematic diagrams illustrating purge processes to be performed in a case where the sub tray of the side stitching machine and the sub tray of the saddle stitching machine are selected as the purge destinations from among the discharge destinations set in the sheet conveyance path shown in FIG. 2.

FIG. 8A is a schematic diagram illustrating a purge process to be performed in a case where the sub tray 403 of the side stitching machine 400 is selected as the purge destination from among the discharge destinations set in the sheet conveyance path shown in FIG. 2, as the side stitching machine 400 has detected a jam JM at the sheet catch tray 401. As shown in FIG. 8A, the sheet (s) remaining on the upstream side of the branching point 801 of the conveyance path in the side stitching machine 400 can be moved to the sub tray 403 of the side stitching machine 400 selected as the purge destination. In accordance with the sheet location information 621, the purge control unit 612 identifies the sheets remaining on the upstream side of the branching point 801, determines the order of conveyance of those sheets, and causes the conveying unit 70 and the like to convey those sheets to the sub tray 403 of the side stitching machine 400. Meanwhile, the purge control unit 612 causes the conveying unit 70 and the like to leave the remaining sheets on the downstream side of the branching point 801 as they are, including the sheets remaining in the processing path SIP in the saddle stitching machine 200, the processing path MTP in the case binding machine 300, and the processing path SDP in the side stitching machine 400, and the sheet having caused the jam JM, which cannot be conveyed to the sub tray 403 of the side stitching machine 400. These sheets are removed directly from the paths by the user.

Figure 8B:
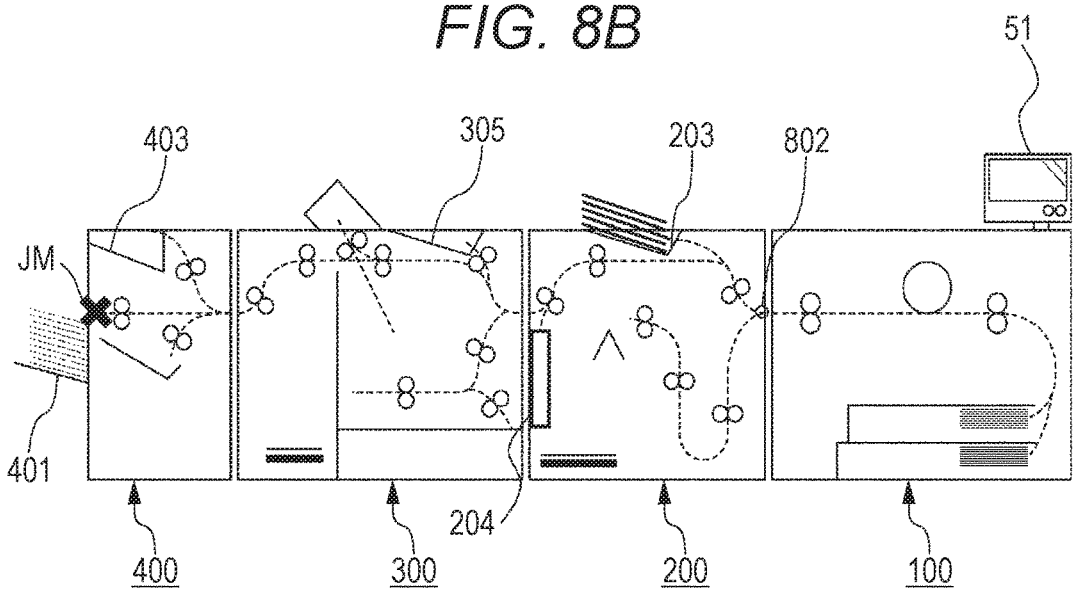

FIG. 8B is a schematic diagram illustrating a purge process to be performed in a case where the sub tray 203 of the saddle stitching machine 200 is selected as the purge destination, as the side stitching machine 400 has detected the jam JM at the sheet catch tray 401. As shown in FIG. 8B, the sheet (s) remaining on the upstream side of the branching point 802 of the conveyance path in the saddle stitching machine 200 can be moved to the sub tray 203 of the saddle stitching machine 200 selected as the purge destination. In accordance with the sheet location information 621, the purge control unit 612 identifies the sheets remaining on the upstream side of the branching point 802, determines the order of conveyance of those sheets, and causes the conveying unit 70 and the like to convey those sheets to the sub tray 203 of the saddle stitching machine 200. Meanwhile, the purge control unit 612 causes the conveying unit 70 and the like to leave the sheets remaining on the downstream side of the branching point 802 as they are, including the sheets remaining in the processing path SLP in the saddle stitching machine 200 and the sheet having caused the jam JM, which cannot be conveyed to the sub tray 203 of the saddle stitching machine 200. These sheets are removed directly from the paths by the user.

—Procedures in a Purge Process—

Figure 9:
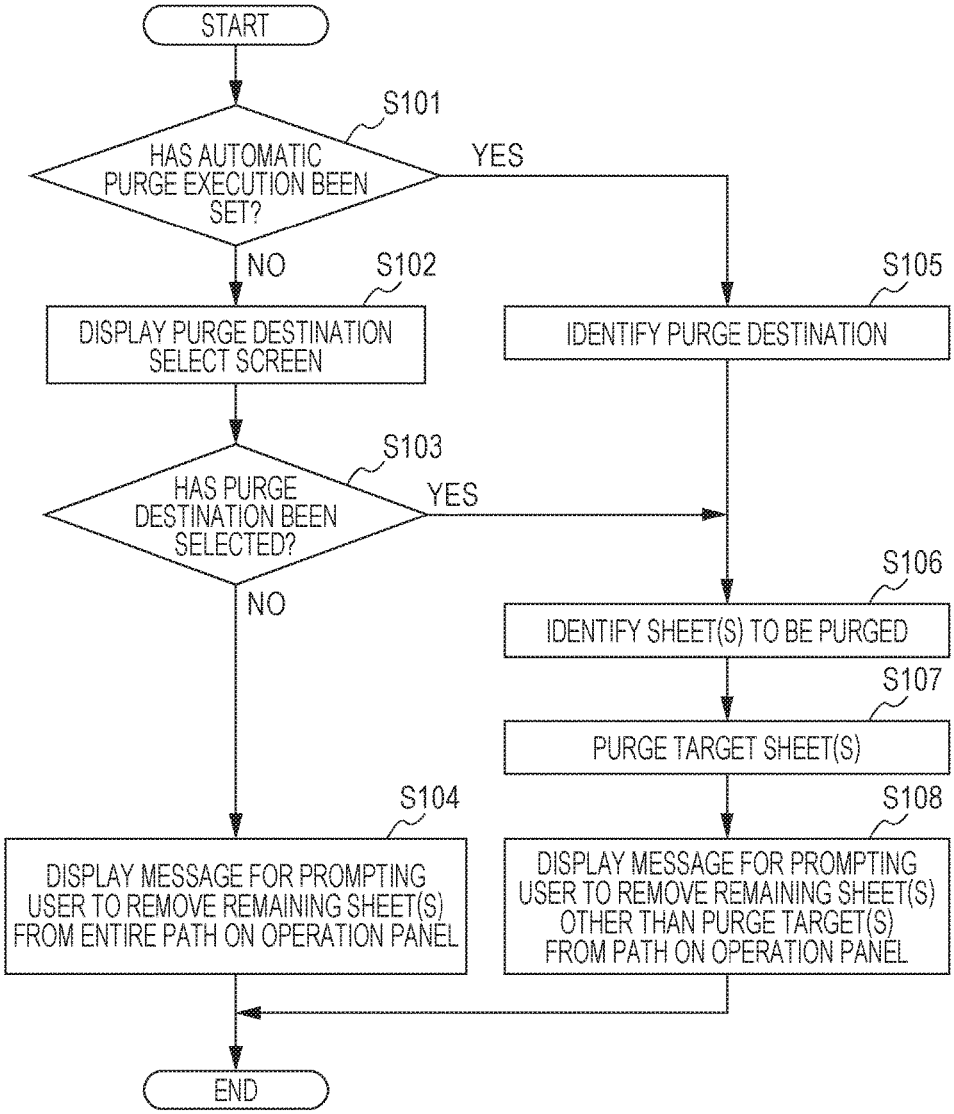
FIG. 9 is a flowchart of a purge process to be performed by the image forming apparatus shown in FIG. 1.

FIG. 9 is a flowchart of a purge process. This process is started in a case where the selecting unit 611 confirms that the initial settings indicate execution of a purge process, after activated upon detection of a jam by the monitoring unit 610 and causing the conveying unit 70 and the post-processing unit 150 to suspend the sheet conveyance.

In step S101, the selecting unit 611 determines whether the initial settings indicate that the purge process is to be performed in the automatic mode. If the initial settings do not indicate execution in the automatic mode, the process moves on to step S102. If the initial settings indicate execution in the automatic mode, the process moves on to step S105.

In step S102, the initial settings do not indicate that the purge process is to be performed in the automatic mode. This means that the purge process is to be performed in the manual mode. Therefore, the selecting unit 611 instructs the operating unit 50 to display the purge destination select screen in the form of a pop-up on the operation panel 51. After that, the process moves on to step S103.

In step S103, the selecting unit 611 determines whether a notification from the operating unit 50 indicates that a purge destination has been selected by a user operation performed on the select screen. If the notification does not indicate any purge destination selected by the user, the process moves on to step S104. If the notification indicates a purge destination selected by the user, the process moves on to step S106.

In step S104, the selecting unit 611 determines that the user has rejected the purge process, as the notification from the operating unit 50 indicates that the cancel button 712 has been pressed, or does not indicate any purge destination selected by the user. On the basis of the determination, the selecting unit 611 further instructs the operating unit 50 to display a message for prompting the user to remove the remaining sheets from the entire path, as well as a massage or the like indicating the detection of the jam, on the operation panel 51. After that, the process comes to an end.

In step S105, the selecting unit 611 further identifies the fixed purge destination from the initial settings, or selects a purge destination in accordance with the selecting condition indicated by the initial settings, as the initial settings indicate that the purge process is to be performed in the automatic mode. After that, the process moves on to step S106.

In step S106, the selecting unit 611 has already identified the purge destination from the initial settings in a case where the initial settings indicate that the purge process is to be performed in the automatic mode. In a case where the initial settings indicate that the purge process is to be performed in the manual mode, on the other hand, the notification from the operating unit 50 indicates a discharge destination selected by the user. Therefore, the selecting unit 611 determines the purge destination to be the discharge destination indicated by the notification. The selecting unit 611 then activates the purge control unit 612, and notifies the purge control unit 612 of the identified purge destination. In accordance with the sheet location information 621, the purge control unit 612 identifies the sheet(s) that can be moved to the designated purge destination among the sheets remaining in the path, and determines the identified sheet(s) to be the purge target(s). After that, the process moves on to step S107.

In step S107, the purge control unit 612 causes the conveying unit 70 and the like to convey the sheet(s) as the purge target(s) to the purge destination. Meanwhile, the purge control unit 612 causes the conveying unit 70 and the like to leave the remaining sheet (s) other than the purge target (s) in the path. After that, the process moves on to step S108.

In step S108, the purge control unit 612 confirms that the conveying unit 70 and the like have conveyed all the purge target sheet(s) to the purge destination. The selecting unit 611 then instructs the operating unit 50 to display a message for prompting the user to remove the remaining sheet(s) other than the purge target(s) from the path, as well as a message or the like indicating the detection of the jam, on the operation panel 51. After that, the process comes to an end.

Advantages of the Embodiment

In the image forming apparatus according to an embodiment of the present invention, when the monitoring unit 610 detects a jam, the selecting unit 611 causes the conveying unit 70 and the like to suspend the sheet conveyance, and causes the operating unit 50 to display a purge destination select screen in accordance with initial settings indicating that a purge process is to be performed in the manual mode. When the operating unit 50 receives a purge destination from the user through the select screen, the purge control unit 612 identifies the sheet (s) that can be moved to the purge destination among the sheets staying in the path, and causes the conveying unit 70 and the like to convey the sheet (s) to the purge destination.

In this manner, the image forming apparatus can cause the user to confirm allowance/rejection of a purge process at the time when a jam is actually detected, and select a specific purge destination. Consequently, the risk of the use forgetting the actual purge destination becomes lower. Thus, this image forming apparatus can avoid the risk of the user failing to remove the purged sheet(s), even though the image forming apparatus includes a number of discharge destinations that can be used as purge destinations, such as the sub tray 203 and the purge tray 204 of the saddle stitching machine 200, the sub tray 305 of the case binding machine 300, and the sheet catch tray 401 and the sub tray 403 of the side stitching machine 400. In a case where the target in a job is printing an image with a high security level, such as an image of a confidential document, the user should set the purge process in the manual mode so that a sheet on which the image is formed can be prevented from mixing with other printed materials at a purge destination and being exposed to a third party.

[Modifications]

(A) The main unit 100 of the image forming apparatus shown in FIG. 1 has the functions of a scanner, a copying machine, and a laser printer. The main unit of an image forming apparatus according to an embodiment of the present invention may have the function of any of the following machines: a laser printer, an ink jet printer, a facsimile machine, a copying machine, and the like. Particularly, the imaging unit may be compatible with color image formation, unlike the imaging unit 20 compatible with monochrome image formation shown in FIGS. 2 and 3.

(B) The post-processing unit shown in FIG. 1 can perform the three kinds of post-processing, which are saddle stitching, case binding, and side stitching, with the three machines, which are the saddle stitching machine 200, the case binding machine 300, and the side stitching machine 400. The post-processing may further include a process of sorting out sheets, a process of forming binding holes in sheets, a process of folding sheets two or three times, a process of inserting sheet into a bundle of sheets, and the like.

(C) The purge process following detection of a jam is normally one of the two types: a process to be performed before the sheet having caused the jam is manually removed from the path by the user (pre-purge), and a process to be performed immediately before the job is resumed (auto-purge). A purge process to be performed in an image forming apparatus according to an embodiment of the present invention may be one of these two types of processes.

(D) As shown in FIG. 7, the operating unit 50 displays the purge destination select screen 710 in the form of a pop-up on the operation screen 700. Alternatively, the operating unit 50 may display the select screen after erasing the operation screen from the operation panel 51, or may divide the operation penal 51 and display the select screen and the operation screen separately from each other.

(E) While determining the purge target(s) to be the sheet(s) that can be conveyed to the purge destination among the sheets remaining in the path, the purge control unit 612 causes the conveying unit 70 and the like to leave the remaining sheet(s) other than the purge target(s) in the path. The purge control unit 612 may also cause the conveying unit 70 and the like to convey the movable sheet(s) among the sheets other than the purge target(s) to one of the discharge destinations. In this case, the selecting unit 611 may instruct the operating unit 50 to display a message or the like indicating that there is/are a sheet (sheets) purged to a discharge destination other than the selected purge destination, and also indicating the discharge destination, on the operation panel 51. With this, the risk of the user failing to remove the purged sheets can be avoided, and the trouble the user has to take to remove sheets from the path can be reduced.

(F) In FIG. 2, the saddle stitching machine 200, the case binding machine 300, and the side stitching machine 400, which constitute the post-processing unit, each include at least one discharge destination that can be a candidate for a purge destination. Alternatively, one of the machines constituting the post-processing unit may not include any discharge destination that can be a candidate for a purge destination.

The select screen 710 shown in FIG. 7 displays all the discharge destinations shown in FIG. 2, which are the sub tray 203 and the purge tray 204 of the saddle stitching machine 200, the sub tray 305 of the case binding machine 300, and the sheet catch tray 401 and the sub tray 403 of the side stitching machine 400, as the candidate purge destinations on the menu 711. Alternatively, the candidate purge destinations to be actually displayed on the menu 711 of the select screen 710 may be automatically selected from among the discharge destinations set in the image forming apparatus. Specifically, the selecting unit 611 first identifies, from the sheet location information 621, the location of the sheet first processed in a job among the sheets staying in the path due to detection of a jam. Particularly, the location of the sheet first processed in a job in which a purge process is to be performed in the manual mode is identified. The selecting unit 611 then selects discharge destinations as candidate purge destinations to which the sheet can be conveyed from the identified location, and instructs the operating unit 50 to display these candidates on the select screen 710.

With this, in a case where a jam happens to a sheet processed in the previous job during a particular job for an image with a high security level such as an image of a confidential document, the user can be made to select a purge destination for the sheets to be processed in the jobs after the particular job. With this, at least these sheets do not remain in the path and are discharged to the purge destination selected by the user. Thus, the risk of exposure of these sheets to a third party can be lowered.

The selecting unit 611 may also display, on the select screen 710, the location of the sheet first processed in a job among the sheets staying in the path due to detection of a jam. In accordance with the displayed location, the user searches for a discharge destination to which the sheet first processed in a job the user has requested can be moved. As the discharge destination can be selected as the purge destination, the sheets processed in the job can be prevented from remaining in the path.

The present invention relates to a sheet purge technique in an image forming apparatus. As described above, when a jam is detected, a purge destination select screen is displayed in the form of a pop-up on the operation screen, and a purge process is performed after a user selects a purge destination. Accordingly, it is apparent that embodiments of the present invention can be used in industries.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an operating unit configured to display an operation screen, and accept a user operation through the operation screen;

a conveying unit configured to convey a sheet along a path to one of a plurality of discharge destinations, the path leading to the discharge destinations;

at least one sensor configured to sense the sheet moving in the path;

an image forming unit configured to form an image on the sheet moving in the path; and a control unit configured to identify a conveyance destination from among the discharge destinations in accordance with the user operation accepted by the operating unit, and cause the conveying unit to convey the sheet to the conveyance destination, wherein:

the control unit is configured to selectively perform control in one of an automatic mode and a manual mode for executing a purge process, the manual mode is set as an initial setting of the image forming apparatus, in the manual mode, after the control unit detects a jam in the path based on an output from the at least one sensor, the control unit causes the conveying unit to suspend sheet conveyance, and causes the operating unit to display a select screen for selecting a purge destination from among the discharge destinations and accept a purge destination selected by a user through the select screen, and after the operating unit accepts the selected purge destination, the control unit identifies a sheet to be moved to the selected purge destination from among sheets staying in the path, and causes the conveying unit to convey the identified sheet to the selected purge destination.

2. The image forming apparatus according to claim 1, wherein the operating unit displays the select screen as a pop-up on the operation screen.

3. The image forming apparatus according to claim 1, wherein the control unit causes the conveying unit to leave remaining sheets among sheets staying in the path in the path, the remaining sheets excluding the sheet to be conveyed to the purge destination accepted by the operating unit, or causes the conveying unit to convey a movable sheet among the remaining sheets to a discharge destination to which the movable sheet can be conveyed among the discharge destinations.

4. The image forming apparatus according to claim 1, further comprising:

at least one post-processing unit configured to perform post-processing on a sheet moving on a downstream side of the image forming unit in the path, wherein at least one of the discharge destinations is assigned to each one of the at least one post-processing unit.

5. The image forming apparatus according to claim 1, wherein the control unit selects a candidate purge destination from among the discharge destinations and displays the candidate purge destination on the select screen, in accordance with a location of the sheet processed first in a job among the sheets staying in the path.

6. A sheet conveyance method implemented in an image forming apparatus, the image forming apparatus including (i) a control unit configured to selectively perform control in one of an automatic mode and a manual mode for executing a purge process, the manual mode being set as an initial setting of the image forming apparatus, (ii) an operating unit configured to display an operation screen, and accept a user operation through the operation screen, (iii) a conveying unit configured to convey a sheet along a path to one of a plurality of discharge destinations, the path leading to the discharge destinations, (iv) at least one sensor configured to sense the sheet moving in the path, and (v) an image forming unit configured to form an image on the sheet moving in the path, and the sheet conveyance method comprising:

identifying a conveyance destination from among the discharge destinations in accordance with the user operation accepted by the operating unit, and causing the conveying unit to convey the sheet to the conveyance destination;

in the manual mode, after the control unit detects a jam in the path based on an output from the at least one sensor, causing the conveying unit to suspend sheet conveyance, and causing the operating unit to display a select screen for selecting a purge destination from among the discharge destinations and accept a purge destination selected by a user through the select screen;

after the operating unit accepts the selected purge destination in the manual mode, identifying a sheet to be moved to the selected purge destination from among sheets staying in the path, and causing the conveying unit to convey the identified sheet to the selected purge destination.

7. The sheet conveyance method according to claim 6, wherein the operating unit displays the select screen as a pop-up on the operation screen.

8. The sheet conveyance method according to claim 6, further comprising causing the conveying unit to leave remaining sheets among sheets staying in the path in the path, the remaining sheets excluding the sheet to be conveyed to the purge destination accepted by the operating unit, or causing the conveying unit to convey a movable sheet among the remaining sheets to a discharge destination to which the movable sheet can be conveyed among the discharge destinations.

9. The sheet conveyance method according to claim 6, wherein:

the image forming apparatus further includes at least one post-processing unit configured to perform post-processing on a sheet moving on a downstream side of the image forming unit in the path, and at least one of the discharge destinations is assigned to each one of the at least one post-processing unit.

10. The sheet conveyance method according to claim 6, further comprising selecting a candidate purge destination from among the discharge destinations and displaying the candidate purge destination on the select screen, in accordance with a location of the sheet processed first in a job among the sheets staying in the path.

* * * * *